US007348511B2

(12) United States Patent
Chen et al.

(10) Patent No.: US 7,348,511 B2
(45) Date of Patent: Mar. 25, 2008

(54) BUTTON DEVICE FOR COMPUTER BEZEL

(75) Inventors: Yun-Lung Chen, Shenzhen (CN); Li Tong, Shenzhen (CN); Quan-Guang Du, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/308,955

(22) Filed: May 29, 2006

(65) Prior Publication Data

US 2007/0187218 A1 Aug. 16, 2007

(30) Foreign Application Priority Data

Feb. 10, 2006 (CN) ..... 2006 2 0054941

(51) Int. Cl.
*H01H 13/02* (2006.01)

(52) U.S. Cl. ..... 200/296; 200/343

(58) Field of Classification Search ..... 200/296, 200/341–345; 341/22; 345/168, 169
See application file for complete search history.

(56) References Cited

U.S. PATENT DOCUMENTS 5,813,520 A * 9/1998 Reier et al. ..... 200/343
6,002,093 A * 12/1999 Hrehor et al. ..... 200/345
6,160,232 A * 12/2000 Lin ..... 200/341
6,384,355 B1 * 5/2002 Murphy et al. ..... 200/344
6,492,605 B2 * 12/2002 Iida ..... 200/343
6,570,111 B2 * 5/2003 Nakagawa et al. ..... 200/343
6,667,447 B2 12/2003 Liu et al.
6,765,164 B2 7/2004 Lee et al.
6,846,999 B2 * 1/2005 Kawakami et al. ..... 200/341
6,914,206 B2 * 7/2005 Mukougawa ..... 200/556
6,964,532 B1 * 11/2005 Lu ..... 400/490
7,002,086 B2 * 2/2006 Fuji ..... 200/305
7,019,237 B2 * 3/2006 Hong ..... 200/296
7,098,417 B1 * 8/2006 Fuji ..... 200/343
7,102,090 B2 * 9/2006 Morisada ..... 200/296

* cited by examiner

*Primary Examiner*—Michael A Friedhofer
(74) *Attorney, Agent, or Firm*—Wei Te Chung

(57) ABSTRACT

A button device for an electronic device, includes a panel defining an opening, a button module, and a switch. The button module has two opposite ends attached to the panel. A button is suspended at a middle of the button module and aligned with the opening of the panel. A triggering member is movable together with the button. The switch is remained a pre-determined distance from the panel, and out of alignment with the opening of the panel. The triggering member is laterally inserted between the switch and the panel for triggering the switch when the button is pressed.

20 Claims, 4 Drawing Sheets

BUTTON DEVICE FOR COMPUTER BEZEL

FIELD OF THE INVENTION

The present invention relates to a button device, more particularly to a button device with integrated simplified configuration.

DESCRIPTION OF RELATED ART

As known to those skilled in the art, a push button is often disposed on a control panel of an electronic device to control a switch behind the control panel.

For example, one conventional push button includes a button unit mounted in a depression of a computer bezel. A push unit passes through the depression and moves by a force transmitted from the button unit. The push unit includes a support part and a push part. A first spring is provided between the button unit and the support part, and a second spring is provided between the support part and the depression. The first and second springs are in a sealed space. When pressing the button unit, the first and second springs are compressed, and the push part is pressed to turn the switch on or off. However, in this conventional button device, the springs and other associated members are separately installed. The assembly process is unduly complicated. Moreover, the push button may become fouled and resist being pressed down.

Accordingly, a button device having a simplified configuration which overcomes the above-mentioned problems is desired.

SUMMARY OF THE INVENTION

A button device for an electronic device, includes a panel defining an opening, a button module, and a switch. The button module has two opposite ends attached to the panel. A button is suspended at a middle of the button module and aligned with the opening of the panel. A triggering member is movable together with the button. The switch is remained a pre-determined distance from the panel, and out of alignment with the opening of the panel. The triggering member is laterally inserted between the switch and the panel for triggering the switch when the button is pressed.

Other objects, advantages, and novel features of the present invention will be drawn from the following detailed description of a preferred embodiment of the present invention with the attached drawings, in which:

DETAILED DESCRIPTION OF THE INVENTION

Figure 1:
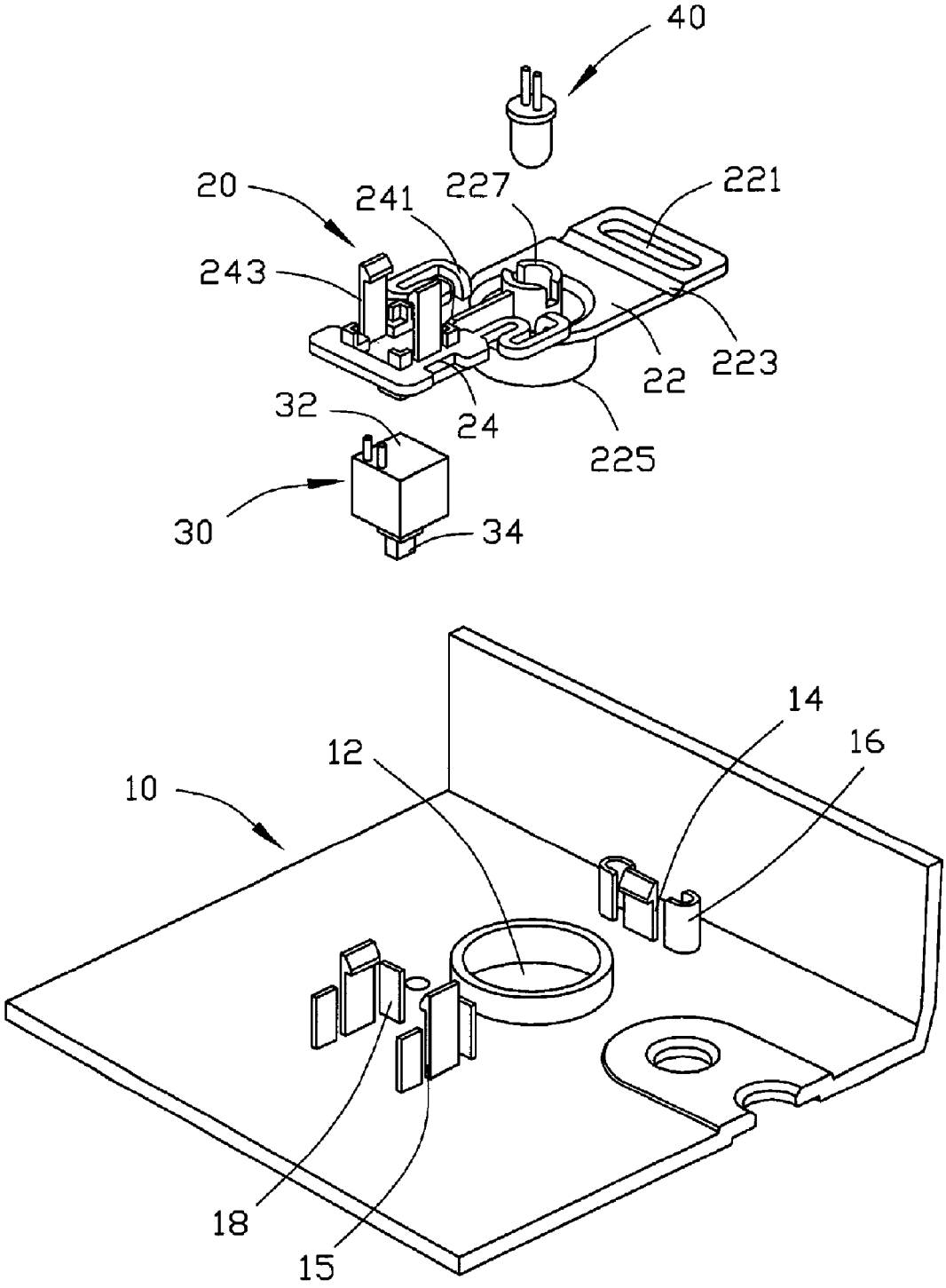
FIG. 1 is an exploded, isometric view of a button device in accordance with a preferred embodiment of the present invention, including a computer panel, a button module, and a switch.

Referring to FIG. 1, a button device in accordance with a preferred embodiment of the present invention includes a computer panel 10, a button module 20, and a switch 30 disposed between the panel 10 and the button module 20.

Figure 2:
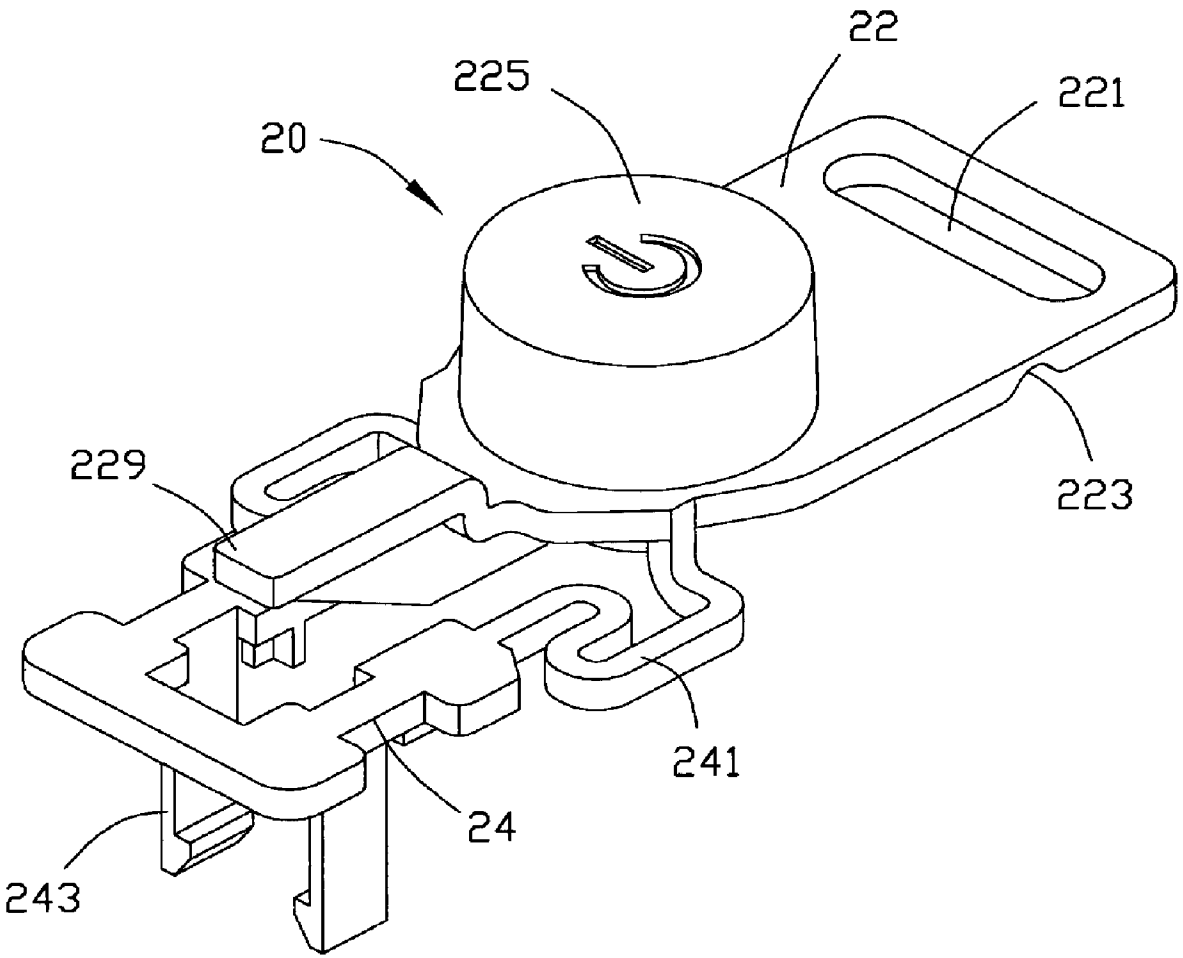
FIG. 2 is an exploded, isometric view of the button module in FIG. 1, but viewed from another aspect.

The computer panel 10 defines an opening 12. A first hook 14 protrudes up from the computer panel 10 at one side of the opening 12. Two semicircular hollow posts 16 respectively protrude from the computer panel 10 at opposite sides of the hook 14. A pair of second hooks 15 facing each other protrudes from the computer panel 10 at the other side of the opening 12. The hook 14 and the hooks 15 cooperate to secure the button module 20 to the panel 10. Two pairs of supporting tabs 18 protrude from the computer panel 10 around the second hooks 15, one pair of supporting tabs 18 being perpendicular to the other pair thereof, Referring also to FIG. 2, the button module 20 includes a rectangular base 22. A button 225 extends up from an outer surface of the base 22, corresponding to the opening 12 in the computer panel 10. A hollow post 227 defining a receiving space protrudes from an inner center surface of the button 225, for a light source 40 disposed therein. A generally elliptic slot 221 is defined at one end of the base 22. An elastic triggering member 229, such as a cantilever, extends forward from another end opposite to the slot 221. A gap 223 is defined in an inner surface of the base 22 adjacent to the elliptic slot 221, for providing elasticity to the base 22, thereby forming an elastic portion. A frame 24 parallel to the triggering member 229 extends down from the base 22 adjacent to the triggering member 229. The frame 24 includes a pair of generally S-shaped resilient arms 241 and one end of each arm 241 is respectively integrated with the base 22 at two sides of the triggering member 229. The other ends of the two arms 241 are integrated with each other with a space defined between the two arms 241. A pair of securing hooks 243 facing each other protrudes from the frame 24 for securing the switch 30 therebetween.

Figure 3:
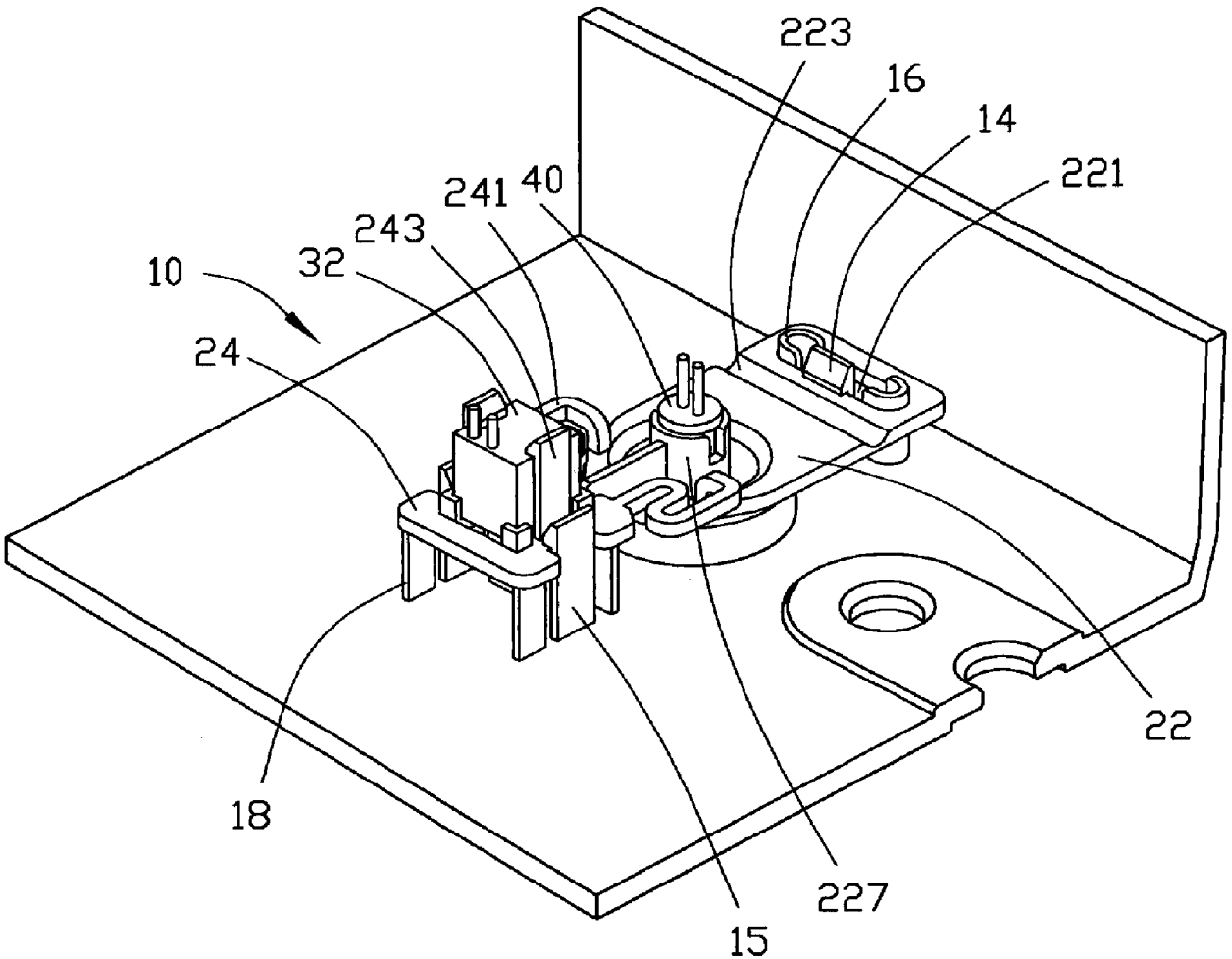
FIG. 3 is an assembled view of FIG. 1.
Figure 4:
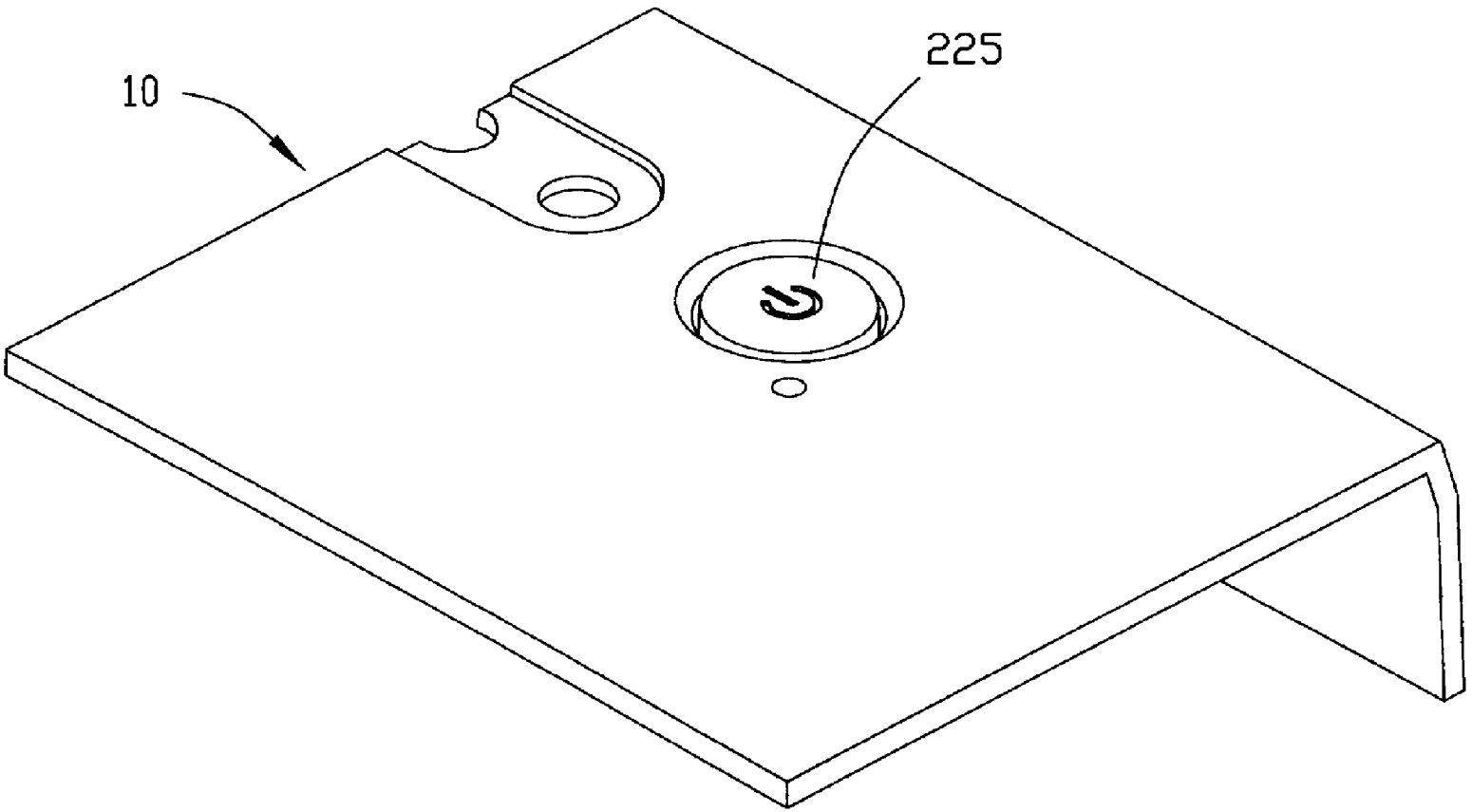
FIG. 4 is an assembled view of FIG. 1, but viewed from another aspect.

The switch 30 is electrically connected with the light source 40, including a square block 32 and a switching post 34 resiliently connected to the square block 32. Referring also to FIGS. 3 and 4, in assembly, the switch 30 is pushed along the securing hooks 243. The securing hooks 243 are forced to elastically expand out by the square block 32. When a top surface of the square block 32 slides down, the hooks 243 rebound back to prevent the switch 30 escaping therefrom. The switching post 34 extends through the space to abut on the triggering member 229 of the button module 20. Then, the button 225 of the button module 20 is aligned with the opening 12 in the computer panel 10, and the slot 221 in the base 22 of the button module 20 is aligned with the first hook 14 and the hollow posts 16. Then, the button module 20 is pushed along the first and second hooks 14 and 15. The hooks 14 and 15 are respectively forced to elastically expand out by side edges of the slot 221 and the frame 24. When the button module 20 moves under the hooks 14 and 15, the hooks 14 and 15 rebound back to prevent the button module 20 disengaging therefrom. The frame 24 of the button module 20 lies on the supporting tabs 18. The semicircular hollow posts 16 fit in the elliptic slot 221, for laterally securing the base 22. The button 225 extends through the opening 12 of the computer panel 10 to be exposed for access from outside of the computer panel 10.

In use, when the button 225 is depressed, the elastic portion of the button module 20 and the resilient arms 241 of the frame 24 are deformed down. The base 22 of the button module 20 is pressed down. The triggering member 229 of the base 22 pushes the switching post 34 to actuate the switch 30. Thereby, the switch 30 is turned on or off. When the button 225 is released, the elastic portion of the button module 20 and the resilient arms 241 of the frame 24 rebound. The switching post 34 returns back to its original position. The button 225 comes back to its original state for a next operation.

It is to be understood, however, that even though numerous characteristics and advantages have been set forth in the foregoing description of preferred embodiments, together with details of the structures and functions of the preferred embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A button device for an electronic device, comprising:

a panel defining an opening;

a button module having two opposite ends attached to the panel, a button suspended at a middle of the button module and aligned with the opening of the panel, a triggering member movable together with the button; and a switch remained a pre-determined distance from the panel, and out of alignment with the opening of the panel, the triggering member laterally inserted between the switch and the panel for triggering the switch when the button is pressed.

2. The button device as described in claim 1, wherein the button module comprises a pair of hooks protruding therefrom, the switch secured between the pair of hooks.

3. The button device as described in claim 2, wherein the button module comprises a base with a slot defined at one end thereof, a first hook protruding up from the panel adjacent the opening for engaging in the slot the triggering member being integrated with an opposite end of the base.

4. The button device as described in claim 3, wherein a gap is defined in the base adjacent the slot for providing elasticity to the base, the gap being perpendicular to a connecting line between the one end and the opposite end of the base.

5. The button device as described in claim 3, wherein the slot is elliptical, and two semicircular posts respectively protrude from the panel at opposite sides of the first hook to be received by the slot.

6. The button device as described in claim 3, wherein the button module comprises a frame, the frame extending from the opposite end of the base of the button module, a pair of second hooks protruding from the panel for engaging with side edges of the frame, the first and second hooks being located at opposite sides of the opening respectively.

7. The button device as described in claim 6, wherein the frame comprises a pair of resilient arms with a space defined therebetween, the two books of the button module extending from the two arms respectively, the switch aligning with the space.

8. The button device as described in claim 7, wherein a plurality of supporting tabs protrude from the panel adjacent to the second hooks, the arms of the frame of the button module abutting on the supporting tabs and blocked by the second hooks.

9. A button device for an electronic device, comprising:

a panel, a pair of hooks protruding from the panel, a plurality of supporting tabs protruding from the panel adjacent to the hooks;

a button module comprising a button and a resilient member integrated with the button, a triggering member extending from the button, the resilient member supported by the supporting tabs of the panel, the hooks of the panel clamping the resilient member against the supporting tabs, a pre-determined distance defined between the resilient member and the panel; and a switch disposed in the button module and abutting on the triggering member.

10. The button device as described in claim 9, wherein an opening is defined in the panel for the button extending therethrough.

11. The button device as described in claim 9, wherein the button module comprises a pair of hooks protruding therefrom, the switch secured between the pair of hooks.

12. The button device as described in claim 9, wherein the button module comprises a base integrated with the button opposite to the resilient member, a slot defined in the base, a hook protruding up from the panel corresponding to the slot for engaging therein.

13. The button device as described in claim 12, wherein a gap is defined in the base adjacent the slot, for providing elasticity to the base.

14. The button device as described in claim 12, wherein the slot is elliptical, and a pair of semicircular posts respectively protrude from the panel, for inserting in the slot.

15. The button device as described in claim 12, wherein the triggering member is a cantilever extending from a free end of the base apposite to the slot, and parallel to the resilient member.

16. The button device as described in claim 12, wherein the button is a hollow cylinder protruding from the base, and a hollow receiving post protrudes from an inner center face of the cylinder.

17. A button device for an electronic device, comprising:

a panel defining an opening;

an integral button module having two opposite ends locked with the panel at opposite sides of the opening, a button located between said two opposite ends of the button module and aligned with the opening of the panel, and a triggering member extending from the button to one of the two opposite ends and being movable together with the button; and a switch retained at said one of the opposite ends of the button module, wherein the triggering member is movable in a same direction with the button to trigger the switch when the button is pressed.

18. The button device as described in claim 17, wherein the button module further comprises a base from which the button extends, a resilient member integrated with one end of the base, the switch being retained at the resilient member.

19. The button device as described in claim 18, wherein the resilient member comprises a space and a frame surrounding the space and spaced from the panel, a pair of hooks extending from the frame in directions away from the panel and retaining the switch therebetween, the triggering member located between the frame and the panel, the switch extending through the space to abut the triggering member.

20. The button device as described in claim 19, wherein the button is a hollow cylinder protruding from the base, and a hollow receiving post protrudes from the cylinder for receiving a light source which is electrically connected with the switch.

* * * * *